United States Patent [19]

Sugiura

[11] 4,389,129

[45] Jun. 21, 1983

[54] TYPE WHEEL PRINTER

[75] Inventor: Toshiaki Sugiura, Nagoya, Japan

[73] Assignee: Brother Kogyo Kabushiki Kaisha, Nagoya, Japan

[21] Appl. No.: 275,013

[22] Filed: Jun. 18, 1981

[30] Foreign Application Priority Data

Jun. 30, 1980 [JP] Japan ..... 55-89346
Jun. 30, 1980 [JP] Japan ..... 55-89347

[51] Int. Cl.[3] ..... B41J 1/30

[52] U.S. Cl. ..... 400/144.2; 400/54; 400/175

[58] Field of Search ..... 400/144.2, 144.3, 174, 400/175, 54; 101/93.17-93.19

[56] References Cited

U.S. PATENT DOCUMENTS

| | | | |
|---|---|---|---|
| 3,878,929 | 4/1975 | Orlens et al. | 400/144.3 X |
| 3,983,985 | 10/1976 | Guerrini et al. | 400/144.2 |
| 4,049,110 | 9/1977 | Frechette | 400/144.2 X |
| 4,245,916 | 1/1981 | Habich et al. | 400/175 X |
| 4,264,220 | 4/1981 | Okcuoglu | 400/144.2 |
| 4,291,993 | 9/1981 | Gagnebin | 400/144.2 |
| 4,310,255 | 1/1982 | Asano et al. | 400/175 X |
| 4,314,770 | 2/1982 | Harre | 400/144.2 X |

FOREIGN PATENT DOCUMENTS

| | | | |
|---|---|---|---|
| 2902544 | 8/1980 | Fed. Rep. of Germany | 400/144.2 |
| 2022022 | 12/1979 | United Kingdom | 400/175 |

OTHER PUBLICATIONS

*IBM Tech. Disc. Bulletin,* by C. M. McCray, vol. 18, No. 9, Feb. 1976, pp. 2988-2989.

*Primary Examiner*—Paul T. Sewell
*Attorney, Agent, or Firm*—Browdy and Neimark

[57] ABSTRACT

A printer employing a daisy-type wheel. On a hub of the type wheel a pin is slidably disposed and is backwardly biased by a spring to protrude from the rear surface of the hub. In a central opening of the hub a hair pin spring having a pair of arms is disposed. The type wheel is mounted on a drive shaft of a motor through a coupling element. The coupling element is provided with a projection which is fitted into the opening of the hub and engaged with the arms of the hair pin spring by a snap action to latch the type wheel to the drive shaft in the axial direction. In the axially latched state the pin protrudes from the front surface of the hub, resisting the resilient force of the spring, by the coupling element. When the coupling element is rotated more than one turn the protruding pin is engaged with a stationary projection to prevent the type wheel from rotating, with the result that the pin is aligned with a notch formed in the coupling element and is fitted into the same for latching the type wheel to the drive shaft in the rotational direction.

13 Claims, 13 Drawing Figures

TYPE WHEEL PRINTER

BACKGROUND OF THE INVENTION

This invention relates to a printer or printing apparatus employing a daisy-type type wheel and, more particularly, to structure of the daisy-type type wheel and a mounting mechanism thereof.

Many disclosures relate to the structure of the daisy-type type wheel and the mounting or loading mechanism of this kind of type wheel to the printer are known, such as U.S. Pat. No. 4,049,110, U.S. Pat. No. 4,124,312, and U.S. Pat. No. 4,127,335.

Those prior art devices all have problems, in having either a structure wherein the operator himself must manually align the home position of a drive shaft for the type wheel supported by the printer with the home position of the type wheel, or another structure wherein positioning in the direction of rotation between the drive shaft and the type wheel must be done by locking the drive shaft at a predetermined position by a locking device while on the other hand by maintaining the type wheel at a predetermined position in the rotational direction relatively to a type wheel cartridge containing the type wheel by another locking device disposed therebetween.

In the former type structure positioning of the type wheel when it is mounted or loaded is not only troublesome for the operator but also likely to cause damage to it due to an operator's mistake resulting from the troublesome handling. The latter structure is, notwithstanding of its improvement in having eliminated the defect in the former, not free from another problem such that each of the printer, the cartridge and the type wheel has to be provided with a structure or means related to the above-mentioned two locking devices, leading naturally to complication in structure and increase of the manufacturing cost.

SUMMARY OF THE INVENTION

It is an overall object of this invention to provide a type wheel which is extremely easy in its mounting and removing operations and a printer provided with an improved mounting mechanism for the type wheel.

It is another object of this invention to provide a printer wherein relative positioning in the rotational direction between the drive shaft and the type wheel can be easily and exactly executed.

It is still another object of this invention to provide a printer having a mounting-and-removing mechanism which is simple in structure and inexpensive in manufacturing cost.

According to this invention there is provided a type wheel printer having a carriage, a motor supported by the carriage, and a rotatable shaft extending from the motor and having a coupling member at an end thereof, wherein the improvement comprises (1) a type wheel having a plurality of spokes extending from a hub, types supported at the free ends of the spokes, said hub having an opening formed at a central portion thereof to receive said shaft and axial latch means for latching said type wheel against said shaft inserted into said opening in the axial direction of said shaft, (2) rotational latch means provided between said coupling member and said hub for latching said type wheel against said shaft in the rotational direction of said shaft, said rotational latch means being formable in a latching state and in a non-latching state, (3) control means for driving said motor so as to rotate said shaft more than one rotation upon a closing operation of an electric switch, and (4) means for rotating said coupling member relative to said type wheel upon an operation of said control means so as to cause said rotational latch means to form in the latching state when said shaft has been inserted into said opening for latching said type wheel against said shaft through said axial latch means and further said rotational latch means is in the non-latching state.

According to this invention there is also provided a type wheel having a plurality of spokes extending from a hub, types supported at the free ends of the spokes, the hub having an opening centered therein for mounting the type wheel on a drive shaft driven by a type wheel motor, wherein the improvement comprises (1) first latch means for latching said type wheel to said drive shaft inserted into said opening in an axial direction of said drive shaft, (2) second latch means for latching said type wheel to said drive shaft in a rotational direction of said drive shaft, and (3) said second latch means including a latch member movably supported by said hub and a resilient means for biasing said latch member so as to engage with said drive shaft at a position away from the center thereof.

DETAILED DESCRIPTION OF THE PREFERRED EMBODIMENTS

With reference to the appended drawing preferred embodiments will be described hereunder.

Figure 1:
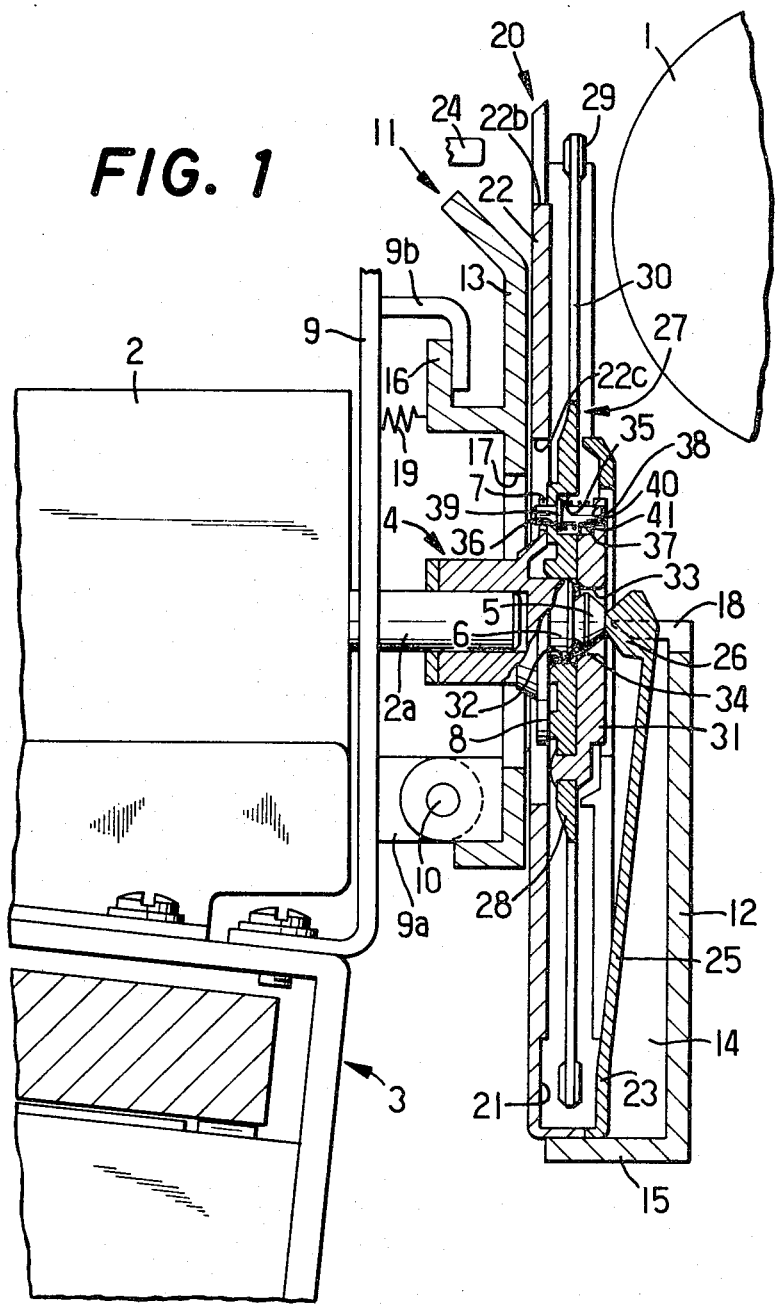
FIG. 1 is a vertical sectional side view of an essential part of a printer in which this invention is realized.

As shown in FIG. 1, on a carriage 3 movably retained in parallel to the printing surface of a platen 1, a type wheel pulse motor 2 is reciprocably supported in a perpendicular direction to the printing surface. This reciprocating movement of the pulse motor 2 in relation to the carriage is executed by a manual operation of a not-shown manual lever. On the front end of a motor shaft 2*a* of the pulse motor 2 a coupling member such as a drive element 4 is firmly fitted. The drive element 4 is, on the front end thereof, provided with a cylindrical portion 6 having a head portion 5 of substantially hexagonal shape in axial section and a flange 8 having an engaging recess such as a notch 7 on the periphery thereof, both being integrally formed. The drive element 4 and the motor shaft 2*a* constitute a rotary or drive shaft means which is driven by the pulse motor 2.

On the carriage 3 a base plate 9 is secured, and on a projection 9*a* disposed on the lower portion thereof a cartridge holder 11 is pivotally mounted on a shaft 10.

Figure 5B:
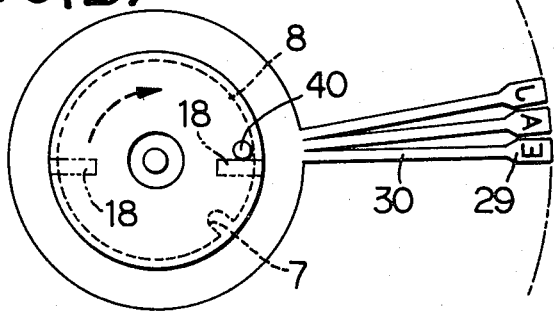
FIG. 5(A)–(C) are respectively partial elevational views showing the positional relations between a pin of the type wheel and a notch formed in a flange of the drive element.
Figure 5C:
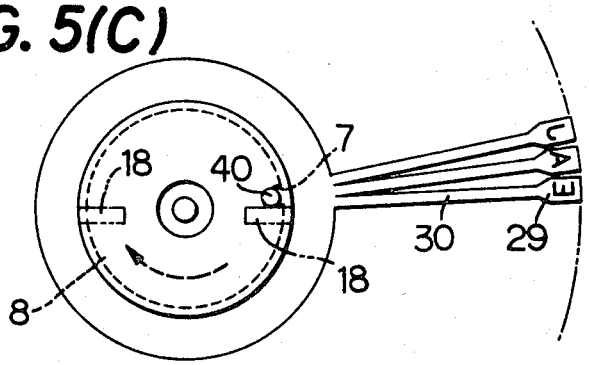
Figure 5A:
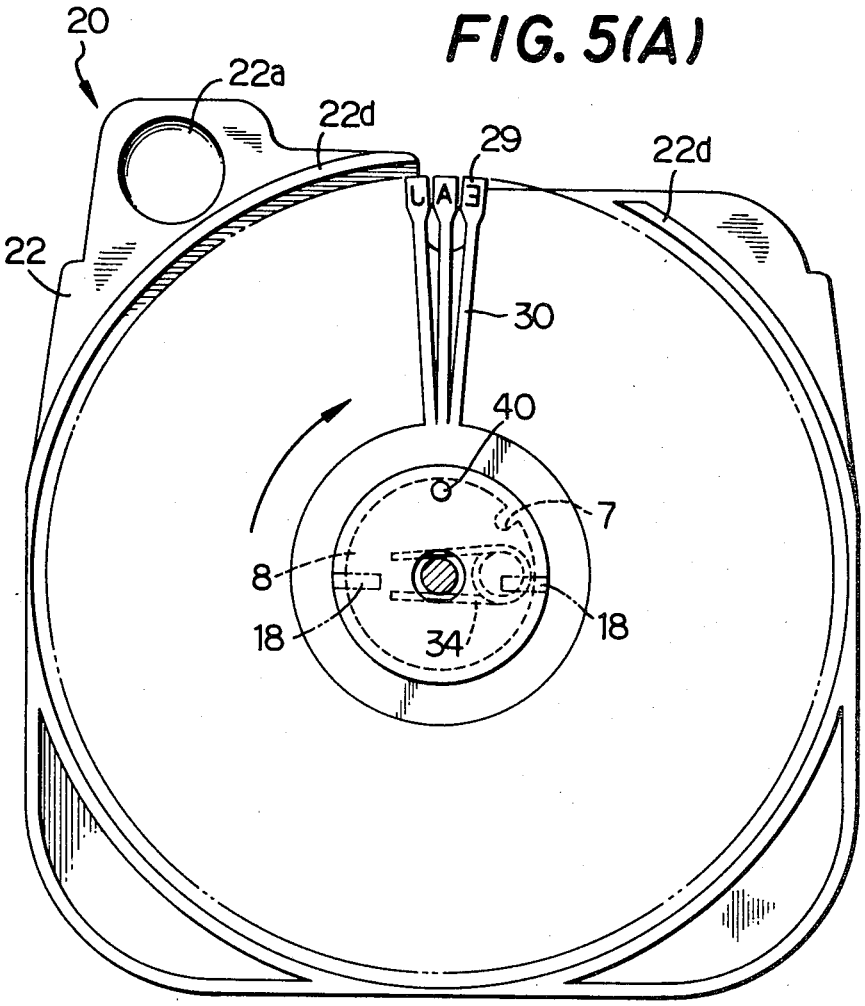

The cartridge holder 11 comprises a front wall 12 on the platen side (the side which faces the platen 1 is called front in this embodiment), a rear wall 13 on the pulse motor side, side walls 14, and a bottom wall 15. The rear wall 13 is provided with a bend portion 16 engageable with an engaging portion 9b formed on the upper portion of the base plate 9 and an opening 17 to allow the flange 8 to go into and come out of the cartridge holder 11. On the upper end of the front wall 12 a pair of detents or engaging projections 18, which are illustrated not only in FIG. 1 but also in FIG. 5(A)–(C), are formed one on each lateral side of the head portion 5 of the drive element 4 at substantially the same height as the center of the head portion 5. A spring 19 is disposed to bias the cartridge holder 11 toward the base plate 9.

Figure 4A:
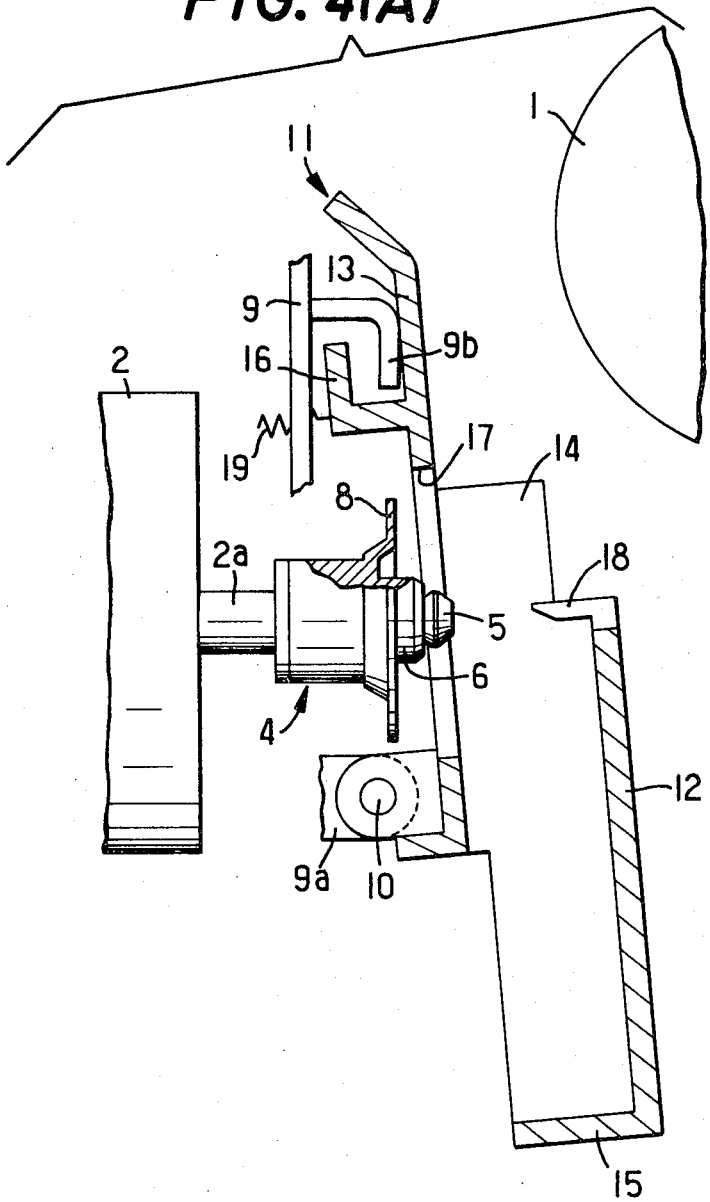
FIG. 4(A)–(D) are respectively partial sectional views showing the positional relations between the drive element and the type wheel.
Figure 4B:
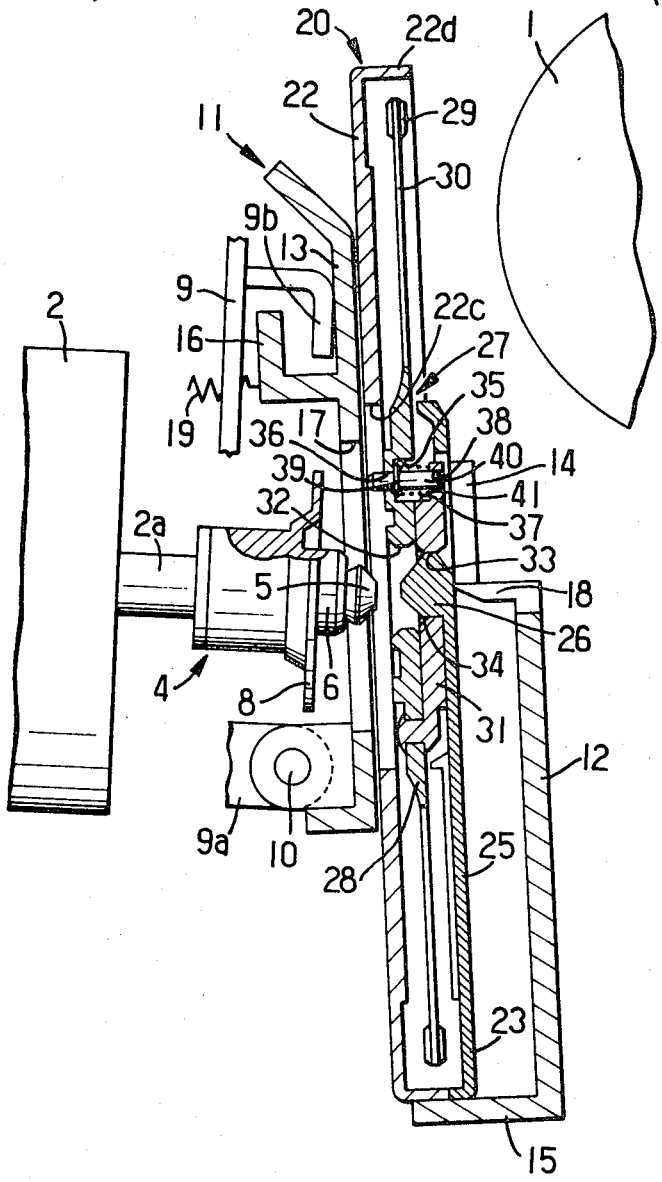
Figure 4C:
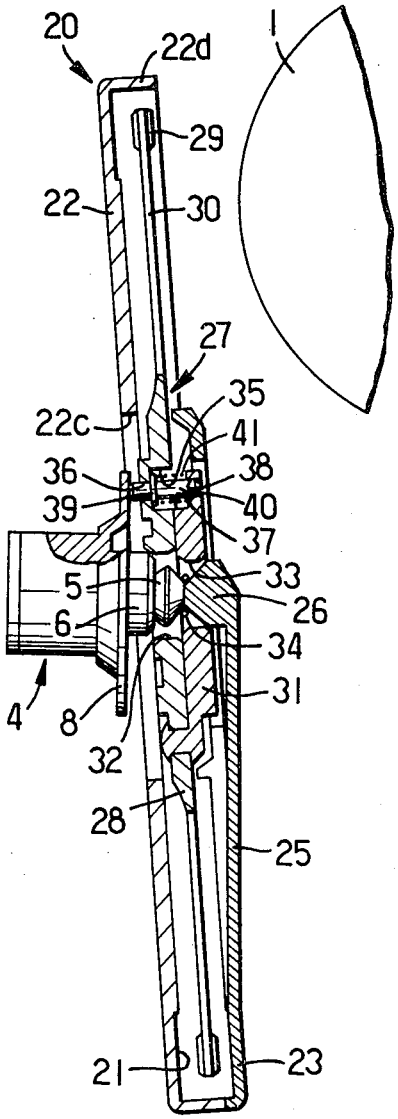

The cartridge holder 11, when the pulse motor 2 is positioned backwardly, is postured rearwardly inclined as shown in FIGS. 4(A) and (B) due to the biasing force of the spring 19, and uprightly positioned, after the forward movement of the pulse motor 2 by a manual operation in one direction of the manual lever, as shown in FIG. 4(C) and (D). By operation of the manual lever in the reverse direction the cartridge holder 11 is moved back to the position shown in FIG. 4(A) and (B).

Figure 3:
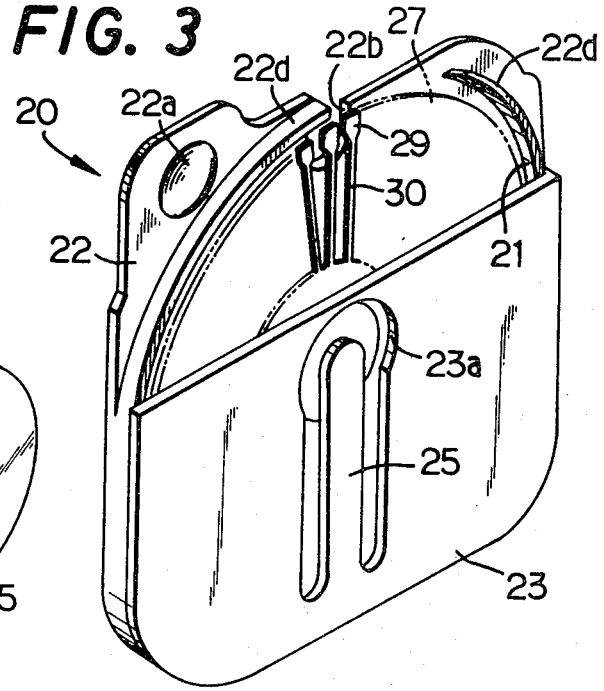
FIG. 3 is a perspective view of a type wheel cartridge in which a type wheel is accommodated.
Figure 2:
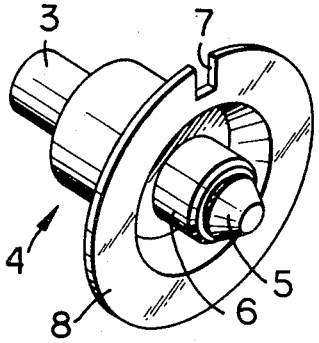
FIG. 2 is a perspective view of a drive element.

A type wheel cartridge 20 accommodated in the cartridge holder 11, as shown in FIG. 3 and FIG. 5(A), is composed of a base plate 22 having a substantially circular recess 21 and a cover plate 23 covering the lower portion of the circular recess 21. On the top portion of the base plate 22 an operating recess 22a for pinching the type wheel cartridge 20 is formed, in the middle of the top portion thereof an aperture 22b is formed by partially notching or cutting away to allow a print hammer 24, shown in FIG. 1, to come and in therethrough, in the central portion thereof an opening 22c for passing the flange 8 to and fro therethrough is formed. On the internal surface thereof a rib 22d formed to define the upper portion of the circular recess 21. In the cover plate 23 a circular opening 23a is formed at a corresponding position to the central portion of the base plate 22, and an elongated elastic tongue 25 is formed from the lower portion of the cover plate 23 so as to reach the circular opening 23a at its upper free end. The tongue 25 is provided on the internal surface of its free end with a projection 26 of substantially conical shape.

A daisy-type type wheel 27 accommodated in the type wheel cartridge 20 is provided with a hub 28 in the center and a multiplicity of spokes 30 with a type 29 on each end portion, being integrally formed of a resin material. On the hub 28 a cap 31 is secured on the platen side so as to function together with the hub 28 as a hub portion of the type wheel 27 itself. In the central portion of the hub 28 an opening or perforation 32 with an internal diameter almost equal to the external diameter of the cylindrical portion 6 of the drive element 4 is formed as a retaining bore, and in the central portion of the cap 31 a central opening or perforation 33 with an internal diameter slightly larger than the maximum external diameter of the head portion 5 of the cylindrical portion 6 is formed. Between the hub 28 and the cap 31 a fastening member such as a wire spring 34 of substantially hair pin shape is mounted as shown in FIG. 5(A), and each arm portion thereof is so arranged as to cross the perforation 33. The distance between the two arms is made larger than the diameter of the tip of the head portion 5 of the cylindrical portion 6 and smaller than the maximum diameter of the head portion 5 by a predetermined value, such that the maximum diameter portion of the head portion 5, when the head portion 5 advances between the arm portions, can pass therethrough due to forced expansion of the distance between the two arm portions. Both arm portions pinch a neck portion between the head 5 and the cylindrical portion 6 to function as an axial latch means for latching the drive shaft inserted into the perforations 32 and 33 in the axial direction thereof.

On the platen side of the hub 28 a recess 35 is formed, and between the internal bottom surface thereof and the rear surface of the hub 28 a perforation 36 parallel to the cylindrical portion 6 is formed. On the other hand, the cap 31 is also provided with a recess 37 at a corresponding position to the recess 35, and between the internal bottom surface thereof and the front surface of the cap 31 a similar perforation 38 is formed. In the space defined by the recesses 35, 37 and the perforations 36, 38 a pin 40 with a rib 39 is mounted for motion back and forth between first and second positions, so that either the front end or the rear end thereof projects outside one of the perforations 38, 36. The pin 40 is, by a resilient member such as a spring 41 supported between the inner surface of the hub 28 and the inner surface of the cap 31, backwardly biased, i.e., kept in the first position, so that the rib 39 is normally abutted on the inner surface of the hub 28 to make the rear end of the pin 40 pierce through the perforation 36 of the hub 28 and thus protrude outside the hub 28 and the front end not protrude outside the cap 31. When the front end of the pin 40 protrudes outside the cap 31, i.e., the pin is placed in the second position, the protruded portion is engaged with the engaging projections 18 during rotation of the type wheel 27.

While the type wheel 27 is accommodated in the circular recess 21 of the type wheel cartridge 20, but is not mounted on to the cylindrical portion 6 of the drive element 4, the projection 26 of the tongue 25 is fitted into the perforation 33 of the cap 31, as shown in FIG. 4(B), so as to center the type wheel 27 in relation to the type wheel cartridge 20 as well as to freely rotatably retain the type wheel 27.

Figure 6:
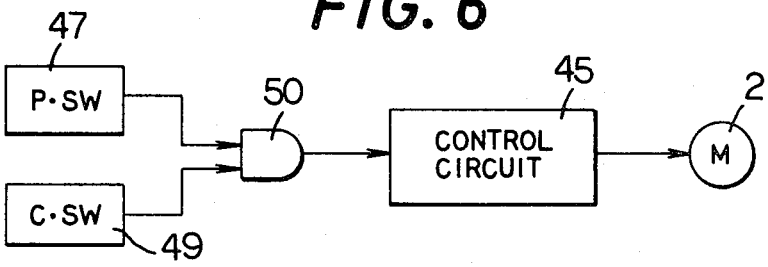
FIG. 6 is a block diagram of an electric circuit of the printer.
Figure 7:
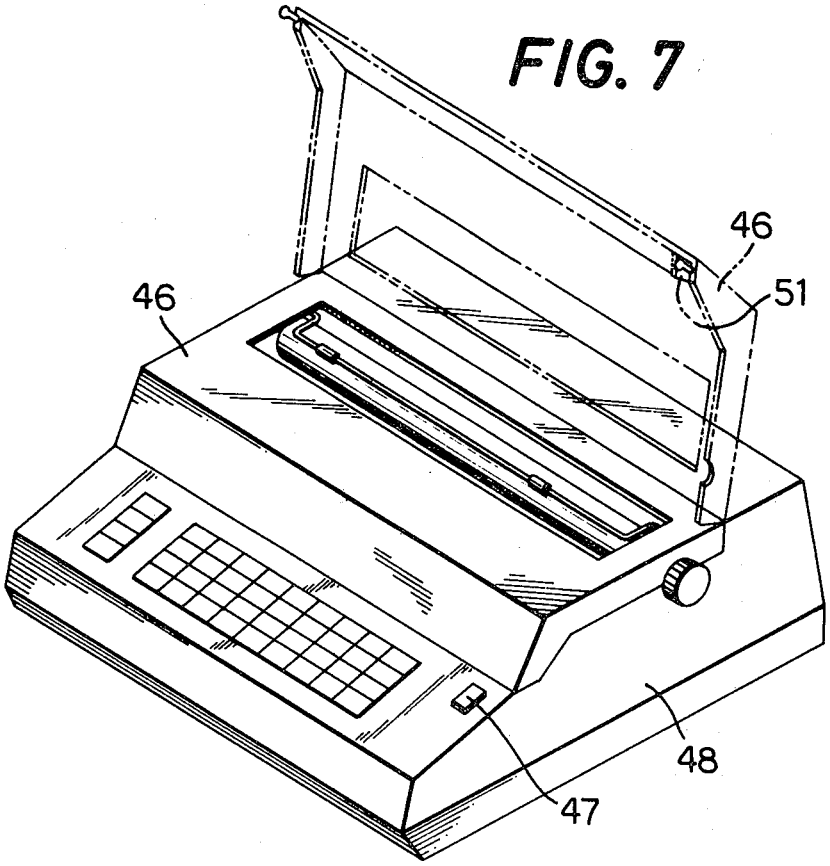
FIG. 7 is a perspective view of the printer.
Figure 8:
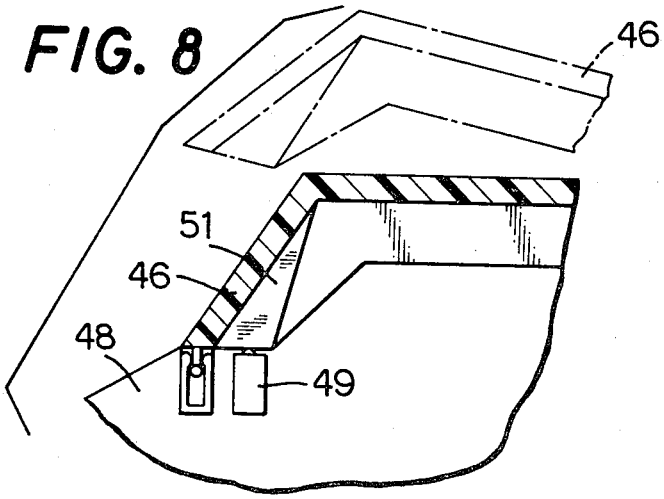
FIG. 8 is a partial view in cross section showing a cover switch of the printer.

This printer or printing apparatus is, as shown in FIG. 6, also provided with a control circuit 45 for rotating the pulse motor 2 more than one turn in one direction in response to the closing operation of a cover 46 and a power switch 47 shown in FIGS. 7 and 8.

In other words, there is provided in the casing 48 of the printer, as shown in FIG. 8, a cover switch 49 which is turned ON by a projection 51 upon closing of the cover 46. As illustrated in FIG. 6, this cover switch 49 is, along with the power switch 47, connected to the control circuit 45 by way of an AND circuit 50. When therefore the cover 46 is closed while the power switch 47 being ON, or when the power switch 47 is turned ON after closing of the cover 46, the pulse motor 2 is automatically rotated more than one turn. In this instance "more than one turn of rotation" includes rotation up to and less than two turns, e.g. one and a half, but in this embodiment the pulse motor 2 is rotated two turns.

When the type wheel cartridge 20 accommodating the type wheel 27 of such structure is attached to the printer, the type wheel cartridge 20 is inserted into the cartridge holder 11 in a state shown in FIG. 4(A), with the tongue 25 positioned on the side of the platen 1 as shown in FIG. 4(B). When the pulse motor 2 is subsequently moved forwardly by means of operation of the manual lever as shown in FIG. 4(C), the head portion 5 and the cylindrical portion 6 begin to advance into the perforation 32 in the type wheel 27 through the opening 22c in the type wheel cartridge 20 in an inclined status, and the head portion 5 is contacted with the projection 26 of the tongue 25 and urges the same against the resilient force thereof toward the platen side so as to finally release the engagement of the projection 26 of the tongue 25 with the perforation 33 the cap 31. When, on the other hand, the position of the notch 7 of the flange 8 coincides or is aligned with that of the pin 40 of the type wheel 27, the notch 7 and the pin 40 will be due to forward movement of the pulse motor 2 fitted together to cause the drive element 4 and the type wheel 27 to be connected or latched at a predetermined relative angular position. However, when the notch 7 and the pin 40 are not aligned with each other, as shown in FIG. 5(A), i.e., the unlatched condition, the pin 40 contacts the front surface of the flange 8. Further forward movement of the pulse motor 2 will erect the cartridge holder 11 to an upright posture against the resilient force of the spring 19 toward the platen side so that it may be retained, with the bend portion 16 of the cartridge holder 11 being engaged with the engaging portion 9b of the base plate 9.

Figure 4D:
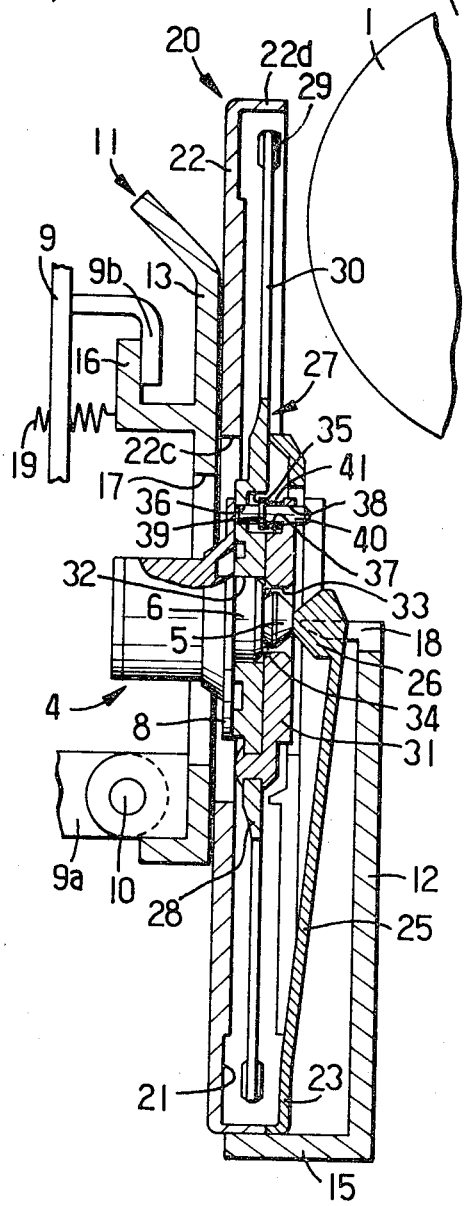

In the process of this forward movement of the pulse motor 2 the head portion 5 of the drive element 4 expands the distance between the two arm portions of the wire spring 34 so as to establish the engagement with the wire spring 34 by a snap action, with the maximum diameter portion thereof having moved past the clearance between the two arm portions as shown in FIG. 4(D), to fit into the perforation 33 of the cap 31. The cylindrical portion 6 is fitted into the perforation 32 of the hub 28 so as to complete the positioning in the axial direction of the drive element 4 and the type wheel 27. As to the relation between the flange 8 and the pin 40, urging of the flange 8 onto the pin 40 takes place against the resilient force of the spring 41, and the front surface of the flange 8 on the platen side comes into contact with the hub 28 to let the front end of the pin 40 project forward, resisting the resilient force of the spring 41. The projection 26 of the tongue 25 is completely pushed out of the perforation 33 of the cap 31 by the head portion 5, with the result of placing the tongue 25 within the interior space of the cartridge holder 11 in a deflected state, all FIG. 1. The type wheel 27 is allowed in this condition to rotate in unison with the drive element 4 due to the friction force between the flange 8 and the hub 28, and the friction force between the wire spring 34 and the head portion 5.

Subsequent closing of the cover 46 of the printer or the power switch 47 causes the control circuit 45 to produce a rotation command signal to rotate the pulse motor 2 two turns. The drive element 4 begins in turn to rotate in one direction actuated by the rotation of the motor shaft 3. The drive element 4 and the type wheel 27 in the unlatched state are rotated integrally in the beginning stage, in the range of 180° at maximum, but the type wheel 27 is prevented from further rotation with the drive element and as soon as the forwardly projected end out of the cap 31 of the pin 40 is engaged with one of the engaging projections 18 of the cartridge holder 11, leaving the drive element 4 to be further rotated alone. In the course of one more rotation the notch 7 of the flange 8 and the pin 40 are aligned with each other, as shown in FIG. 5(C), the rear end of the pin 40 fits into the notch 7, i.e., the pin is moved to its first position, due to the biasing force of the spring 41 so that the front end of the pin 40 will be completely homed into the cap 31. The type wheel 27 and the drive element 4 are therefore latched together at a predetermined relative position in the rotational direction, as shown in FIG. 1, releasing the engagement between the engaging projections 18 and the pin 40. Thus, the drive element 4 and the type wheel 27 are enabled to be rotated in unison through this pin engagement between the two. The drive element 4 will later be halted after having been rotated twice.

In this latched state, the type wheel 27 is placed therefore in a freely rotatable condition relative to the type wheel cartridge 20 and the cartridge holder 11, and is afterwards rotated together with the drive element 4 by subsequent rotation of the pulse motor 2 to allow normal type selecting operations of the type wheel 27.

The removing operation of the type wheel cartridge 20 will be described hereunder. When the manual lever is operated in a reversed manner to that described above as to mounting, with the type wheel cartridge 20 being loaded in place in the cartridge holder 11, the pulse motor 2 is rearwardly moved. In the process of the rearward movement of the pulse motor 2, the cartridge holder 11 is rearwardly moved due to the biasing force of the spring 19 to release the engagement between the projection 9b of the base plate 9 and the bend portion 16 of the cartridge holder 11. Then, the engagement between the notch 7 of the flange 8 and the pin 40 is released, the flange 8 is withdrawn out of the opening 22c of the type wheel cartridge 20 and the opening 17 of the cartridge holder 11, the cylindrical portion 6 completely comes out of the perforation 32 of the hub 28, and the head portion 5 is disengaged from the wire spring 34 and is allowed to completely come out of the perforations 32, 33. As a result of the above, the relative position among the drive element 4, the cartridge holder 11 and the type wheel cartridge 20 is as shown in FIG. 4 (B). On the other hand, the projection 26 of the tongue 25 comes into the perforation 33 following the retreating movement of the head portion 5 out of the just mentioned perforation 33 due to the resilient force of its own. Lifting up of the type wheel cartridge 20 in this position by pinching the same at the operating recess 22a completes the removal of the type wheel cartridge 20 accommodating the type wheel 27 therein out of the cartridge holder 11.

Incidentally, taking out of the type wheel cartridge 20 out of the cartridge holder 11 without inclining the latter, that is, in the upright position illustrated in FIG. 1 is not permissible, because such a removal of the type wheel cartridge 20 risks damage to the ribbon located between the type wheel cartridge 20 and the platen 1.

This invention is not limited to the above described embodiment, but various modification and alterations in shape and structure are allowed so long as they do not deviate from the spirit of the invention and the scope of the following claims.

What is claimed is:

1. In combination, a type wheel printer having a carriage, a motor supported by the carriage, rotatable shaft means driven by the motor;

a type wheel having a hub, a plurality of spokes extending from said hub with a type supported at the free end of each of said plurality of spokes, said hub having a central opening engageable with said shaft means, said hub further having axial latch means for latching said type wheel to said shaft means when the end of said shaft means is inserted into said central opening in an axial direction, said type wheel being susceptible to rotate with said shaft through frictional contact of said type wheel with said shaft means in a rotationally unlatched condition of said shaft means with respect to said type wheel;

rotational latch means for establishing a rotationally latched state wherein said type wheel is latched to said shaft means in the rotational direction of said shaft means;

control means to operate said motor so as to rotate said shaft means a predetermined amount more than one turn upon the closing operation of at least one electric switch; and detent means for preventing said type wheel from rotating more than a predetermined angular amount due to said frictional contact so as to thereafter cause said rotational latch means to establish said rotationally latched state while said shaft means to which said type wheel is axially latched by said axial latch means is rotated in said not rotationally latched state in response to actuation of said control means.

2. The combination of claim 1, wherein said shaft means comprises a flange portion having a surface contacting said hub while said shaft means is axially latched to said type wheel by said axial latch means, said type wheel being rotatable with said shaft means mainly through friction between said flange portion and said hub when said shaft means is rotated in the not rotationally latched state.

3. The combination of claim 2, wherein said flange portion has a notch radially spaced from the center thereof, and said rotational latch means comprises a pin supported by said hub and movable between a first position wherein one end of said pin engages with said notch and a second position where said one end of said pin is not in engagement with said notch, and resilient means biasing said pin toward said first position.

4. The combination of claim 3, wherein the other end of said pin protrudes from said hub when said pin is in said second position, and said detent means comprises projections engageable with said other end of said pin protruding from said hub to prevent said type wheel from rotating while said shaft means continues to rotate.

5. The combination of claim 4, and a cartridge holder carried by said carriage and accommodating a cartridge rotatably supporting said type wheel, and said projections comprising part of said cartridge holder.

6. The combination of claim 5, wherein said carriage comprises a first shaft about which said cartridge holder is pivoted, said first shaft being disposed in parallel to the direction of motion of said carriage, and spring means biasing said cartridge holder toward said shaft means to thereby produce said friction between said flange portion and said hub.

7. The combination of claim 1, said printer further comprising a casing and a cover movable relative to said casing between a closed and an open position, and wherein one said at least one electric switch is disposed in said casing and is automatically turned on when said cover of said printer is placed in said closed position.

8. A type wheel printer having a carriage, a motor supported by the carriage, and a rotatable shaft driven by the motor and having a coupling member at one end thereof;

a type wheel having a hub, a plurality of spokes extending from said hub with a type supported at the free end of each of said spokes, said hub having an aperture formed therein spaced from the center thereof and having a central opening engageable with said coupling member, an axial latch member for latching said type wheel to said coupling member when said coupling member is inserted into said hub central opening in an axial direction of said shaft, a pin, and means to support said pin on said type wheel hub for motion between a first position and a second position, a resilient member biasing said pin towards said first position, and one end of said pin protruding from one surface of said hub in said first position and the other end of said pin protruding from the other surface of said hub in said second position;

engaging means engageable with said other end of said pin positioned in said second position to prevent said type wheel from rotating together with said coupling member;

control means for operating said motor so as to rotate said shaft more than one turn upon a closing operation of at least one electric switch;

said coupling member having a flange portion having a surface contact said one surface of said hub, and a notch engageable with said one end of said pin positioned in said first position for latching said type wheel to said coupling member in the rotational direction of motion of said shaft;

said coupling member being rotated with the type wheel through said control means when said electric switch is closed under conditions where said coupling member inserted into said opening is latched to said type wheel by said axial latch member while said flange portion is in frictional contact with said hub and holds said pin in disengagement from said notch and positioned in said second position against the biasing force of said resilient member;

said type wheel being prevented from rotating with said coupling member after said other end of said pin has been engaged with said engaging means; and said pin being moved from said second position to said first position so as to cause said one thereof to engage with said notch when said notch is aligned with said pin, thereby latching said type wheel to said coupling member in the rotational direction.

9. A type wheel printer having a carriage, a motor supported by the carriage, and a rotatable shaft extending from the motor and having a coupling member at one end thereof;

a cartridge;

a type wheel supported by said cartridge and freely rotatable about an axis relative to said cartridge, said type wheel comprising a hub, a plurality of spokes extending from said hub with a type supported at the free end of each of said spokes, said hub having an aperture formed eccentrically therein and an opening formed in the center thereof engageable with said coupling member, a fastening member for fastening said coupling member inserted into said opening so as to latch said type wheel to said coupling member in an axial direction of said shaft, a pin movably supported in said aperture, and a resilient member for biasing said pin so as to cause one end of said pin to protrude from one surface of said hub;

a cartridge holder supported on said carriage and receiving said cartridge, said cartridge holder having at least one engaging projection engageable with the other end of said pin when said other end of said pin protrudes from the other surface of said hub to prevent said type wheel from rotating;

control means for operating said motor so as to rotate said shaft more than one turn upon a closing operation of at least one electric switch;

said coupling member having a flange portion having a surface contacting said one surface of said hub, and a notch engageable with said one end of said pin for latching said type wheel to said coupling member in the rotational direction of motion of said shaft;

said coupling member being rotated with said type wheel through said control means when said electric switch is turned on under conditions where said coupling member inserted into said opening is latched to said type wheel by said axial fastening member while said flange portion is in frictional contact with said hub and holds said pin in disengagement from said notch and while said other end of said pin protrudes from said other surface of said hub against the biasing force of said resilient member;

said type wheel being prevented from rotating with said coupling member after said other end of said pin has been engaged with said engaging projections; and said notch and said pin engaging when said notch is aligned with said pin, thereby latching said type wheel to said coupling member in the rotational direction of motion of said shaft.

10. A type wheel having a plurality of spokes extending from a hub with a type supported at the free end of each of said spokes, the hub having an opening centered therein for mounting the type wheel on a drive element connected to a type wheel drive motor;

first latch means for latching said type wheel to said drive element when said drive element is inserted into said opening axially of said drive element; and second latch means for latching said type wheel to said drive element in the rotational direction thereof, said second latch means including a pin supported by said hub and movable parallel to the axis of rotation of said type wheel, and further including resilient means for biasing said pin so as to automatically engage with a portion of said drive element radially spaced from the center thereof during rotation of said drive element.

11. A type wheel as claimed in claim 10, further comprising a cap having a central opening coupled to one surface of said hub coaxially therewith, said pin being slidably supported by said hub, and said resilient means comprising a compression spring mounted between said pin and said cap to normally hold said pin in a position wherein one end thereof protrudes from the other surface of said hub to engage with said portion of said drive element.

12. A type wheel as claimed in claim 11, wherein said first latch means comprises a spring disposed in a space formed between said hub and said cap, said spring including a pair of arms movable between a closed position wherein the parts of said arms located within said hub and said cap pinch by resilient force of said spring another portion of said drive element inserted into the central opening of said cap through the opening of said hub, and said spring having an open position wherein they release said another portion of said drive element.

13. A type wheel having a plurality of spokes extending from a hub with a type supported at the free end of each of said spokes, the hub having an opening formed at a central portion thereof for mounting the type wheel on a drive element connected to a type wheel motor;

a cap having a central opening coupled to one surface of said hub and positioned coaxially with the opening of said hub;

a spring disposed in a space formed between said cap and said hub, said spring having a pair of arms movable between an open position for releasing a portion of said drive element and a closed position wherein said arms close on and elastically hold said portion of said drive element when said drive element is inserted into the central opening of said cap through the opening of said hub so as to latch said type wheel to said drive element axially thereof;

an aperture formed in said hub in radially spaced relation to the center thereof;

a pin slidably supported in said aperture; and a resilient member mounted between said cap and said pin for biasing said pin so as to cause one end of said pin to protrude from the other surface of said hub, said pin being engageable with another portion of said drive element inserted into the opening of said hub and latching the type wheel to said drive element in the rotational direction thereof.

* * * * *